US009488359B2

(12) United States Patent
Le et al.

(10) Patent No.: US 9,488,359 B2
(45) Date of Patent: Nov. 8, 2016

(54) PASSIVE PHASE CHANGE RADIATORS FOR LED LAMPS AND FIXTURES

(75) Inventors: Long Larry Le, Morrisville, NC (US); Curtis Progl, Raleigh, NC (US); James Michael Lay, Cary, NC (US); Ronald Blackwell, Timberlake, NC (US); Hattie Blackwell, legal representative, Timberlake, NC (US); Malcolm D. James, Sr., Morrisville, NC (US); Michael D. Poncheri, Cary, NC (US); Jason Taylor, Cary, NC (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 13/430,478

(22) Filed: Mar. 26, 2012
(Under 37 CFR 1.47)

(65) Prior Publication Data

US 2013/0249374 A1 Sep. 26, 2013

(51) Int. Cl.

| | |
|---|---|
| ***F21V 29/00*** | (2015.01) |
| ***F21V 29/58*** | (2015.01) |
| ***F21V 29/71*** | (2015.01) |
| *F21V 3/00* | (2015.01) |
| *F21Y 101/00* | (2016.01) |

(52) U.S. Cl.
CPC ..... *F21V 29/59* (2015.01); *F21V 29/006* (2013.01); *F21V 29/717* (2015.01); *F21V 3/00* (2013.01); *F21Y 2101/00* (2013.01)

(58) Field of Classification Search
CPC ..... F21V 29/006; F21V 3/00
See application file for complete search history.

(56) References Cited

U.S. PATENT DOCUMENTS

| | | | | |
|---|---|---|---|---|
| 2,399,992 A | | 2/1946 | Franck | 362/311.12 |
| 3,143,592 A | * | 8/1964 | August | 174/16.3 |
| 3,581,162 A | | 5/1971 | Wheatley | |
| 4,204,246 A | * | 5/1980 | Arii et al. | 361/699 |
| 4,219,871 A | | 8/1980 | Larrimore | 362/264 |
| 4,727,289 A | | 2/1988 | Uchida | |

(Continued)

FOREIGN PATENT DOCUMENTS

| | | |
|---|---|---|
| CN | 1425117 | 6/2003 |
| CN | 1465106 | 12/2003 |

(Continued)

OTHER PUBLICATIONS

International Search Report and Written Opinion from PCT Application No. PCT/US2012/044705 dated Oct. 9, 2012.

(Continued)

*Primary Examiner* — Elmito Breval
(74) *Attorney, Agent, or Firm* — Koppel, Patrick, Heybl & Philpott

(57) ABSTRACT

Heat management devices and structures are disclosed that can be used in lamps having solid state light sources such as one or more LEDs. Some lamp embodiments comprise one or more phase change radiators that utilize the latent heat of fluids to circulate and draw heat away from the LEDs and radiate the heat into the ambient, allowing for the LEDs to operate at a lower temperature. Some phase change radiators according to the present invention can comprise a main radiator body and multiple radiator coolant loops mounted to the body. The present invention relies on the circulation of heated fluid through the radiator body to radiate heat from the LEDs. The heated liquid moves away from the LEDs and is circulated back to thermal contact with the LEDs thought the coolant loops.

29 Claims, 5 Drawing Sheets

(56) References Cited

U.S. PATENT DOCUMENTS 5,140,220 A 8/1992 Hasegawa
5,463,280 A 10/1995 Johnson
5,535,230 A 7/1996 Abe
5,561,346 A 10/1996 Byrne
5,581,683 A 12/1996 Bertignoll et al.
5,585,783 A 12/1996 Hall
5,655,830 A 8/1997 Ruskouski
5,688,042 A 11/1997 Madadi et al.
5,806,965 A 9/1998 Deese
5,838,101 A 11/1998 Pappalardo ..... 313/487
5,850,126 A 12/1998 Kanbar
5,890,794 A 4/1999 Abtahi et al.
5,931,570 A 8/1999 Yamuro
5,934,798 A 8/1999 Roller et al. ..... 362/497
5,947,588 A 9/1999 Huang
5,949,347 A 9/1999 Wu
5,956,106 A 9/1999 Petersen
5,959,316 A 9/1999 Lowery
6,218,785 B1 4/2001 Incerti ..... 315/185 S
6,220,722 B1 4/2001 Begemann
6,220,731 B1 4/2001 Ryan ..... 362/373
6,227,679 B1 5/2001 Zhang et al.
6,234,648 B1 5/2001 Borner et al.
6,250,774 B1 6/2001 Begemann et al.
6,270,722 B1 8/2001 Yang et al. ..... 422/37
6,276,822 B1 8/2001 Bedrosian et al.
6,350,041 B1 2/2002 Tarsa et al. ..... 362/231
6,404,131 B1 6/2002 Kawano et al. ..... 315/82
6,465,961 B1 10/2002 Cao ..... 315/58
6,517,221 B1 * 2/2003 Xie ..... 362/373
6,523,978 B1 2/2003 Huang
6,550,953 B1 4/2003 Takahashi et al.
6,634,770 B2 10/2003 Cao
6,659,632 B2 12/2003 Chen
6,709,132 B2 3/2004 Ishibashi
6,746,885 B2 6/2004 Cao ..... 438/26
6,758,582 B1 7/2004 Hsiao ..... 362/302
6,764,202 B1 7/2004 Herring et al. ..... 362/371
6,803,607 B1 10/2004 Chan et al.
6,848,819 B1 2/2005 Arndt et al.
6,860,620 B2 3/2005 Kuan et al. ..... 362/294
6,864,513 B2 3/2005 Lin et al.
6,910,794 B2 * 6/2005 Rice ..... 362/547
6,948,829 B2 9/2005 Verdes et al.
6,982,518 B2 1/2006 Chou et al.
6,997,580 B2 2/2006 Wong
7,048,412 B2 5/2006 Martin et al.
7,080,924 B2 7/2006 Tseng et al.
7,086,756 B2 8/2006 Maxik
7,086,767 B2 8/2006 Sidwell et al.
7,094,362 B2 8/2006 Setlur et al. ..... 252/301
7,140,753 B2 * 11/2006 Wang et al. ..... 362/294
7,144,135 B2 12/2006 Martin et al.
7,160,012 B2 1/2007 Hilscher et al.
7,160,120 B2 1/2007 Zhang et al.
7,165,866 B2 1/2007 Li
7,172,314 B2 2/2007 Currie et al.
7,213,940 B1 5/2007 Van de Ven et al. ..... 257/89
D546,980 S 7/2007 Lo
7,250,715 B2 7/2007 Mueller ..... 313/485
7,270,446 B2 * 9/2007 Chang et al. ..... 362/294
D553,267 S 10/2007 Yuen
7,350,936 B2 4/2008 Ducharme et al. ..... 362/231
7,354,174 B1 4/2008 Yan
7,377,674 B2 5/2008 Klinkman et al. ..... 362/484
7,396,142 B2 7/2008 Laizure, Jr. et al.
7,405,857 B2 7/2008 Ma et al.
7,413,325 B2 8/2008 Chen ..... 362/249.01
D581,556 S 11/2008 To et al. ..... D26/2
7,547,124 B2 * 6/2009 Chang et al. ..... 362/373
7,549,782 B2 6/2009 Ng et al. ..... 362/555
7,553,047 B2 6/2009 Shin et al. ..... 362/294
7,600,882 B1 10/2009 Morejon et al.
7,607,802 B2 10/2009 Kang et al. ..... 362/294
7,614,759 B2 11/2009 Negley
7,618,157 B1 11/2009 Galvez
7,663,315 B1 2/2010 Hulse ..... 313/512
7,686,478 B1 3/2010 Hulse et al. ..... 362/255
7,710,016 B2 5/2010 Miki ..... 257/98
7,726,836 B2 6/2010 Chen
7,740,365 B2 6/2010 Huttner et al. ..... 362/97
7,753,568 B2 * 7/2010 Hu et al. ..... 362/373
7,810,954 B2 10/2010 Kolodin ..... 362/277
7,824,065 B2 11/2010 Maxik
D629,928 S 12/2010 Chen
7,884,538 B2 2/2011 Mitsuishi et al. ..... 313/502
7,909,481 B1 3/2011 Zhang ..... 362/249.02
7,976,335 B2 7/2011 Weber et al. ..... 439/487
7,989,236 B2 8/2011 Yamaguchi et al. ..... 438/26
8,021,025 B2 9/2011 Lee
8,235,571 B2 8/2012 Park ..... 362/555
8,253,316 B2 8/2012 Sun et al.
8,272,762 B2 9/2012 Maxik et al.
8,274,241 B2 9/2012 Guest et al.
8,277,082 B2 10/2012 Dassanayake et al.
8,282,250 B1 10/2012 Dassanayake et al.
8,292,468 B2 10/2012 Narendran et al.
8,309,969 B2 11/2012 Suehiro et al. ..... 257/79
8,314,537 B2 11/2012 Gielen et al. ..... 313/46
8,322,896 B2 12/2012 Falicoff et al.
8,348,470 B2 * 1/2013 Liu et al. ..... 362/294
8,371,722 B2 2/2013 Carroll
8,400,051 B2 3/2013 Hakata et al.
8,410,512 B2 4/2013 Andrews ..... 257/99
8,415,865 B2 4/2013 Liang et al.
8,421,320 B2 4/2013 Chuang
8,421,321 B2 4/2013 Chuang
8,421,322 B2 4/2013 Carroll et al.
8,449,154 B2 5/2013 Uemoto et al.
8,502,468 B2 8/2013 Li et al.
8,568,009 B2 * 10/2013 Chiang et al. ..... 362/563
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
8,922,106 B2 12/2014 Helbing et al. ..... 313/318.11
9,316,386 B2 4/2016 Breidenassel
2002/0047516 A1 4/2002 Iwasa et al. ..... 313/512
2002/0114169 A1 8/2002 Harada ..... 362/558
2003/0021113 A1 1/2003 Begemann
2003/0038291 A1 2/2003 Cao
2003/0081419 A1 5/2003 Jacob et al. ..... 362/364
2003/0185005 A1 10/2003 Sommers et al.
2004/0021629 A1 2/2004 Sasuga et al.
2004/0159846 A1 8/2004 Doxsee
2004/0201990 A1 10/2004 Meyer
2004/0223315 A1 11/2004 Suehiro et al. ..... 362/84
2005/0068776 A1 3/2005 Ge ..... 362/296.08
2005/0168990 A1 * 8/2005 Nagata et al. ..... 362/294
2005/0174780 A1 8/2005 Park ..... 362/294
2005/0184638 A1 8/2005 Mueller ..... 313/485
2005/0219060 A1 10/2005 Curran et al. ..... 340/815.45
2005/0225988 A1 10/2005 Chaves et al.
2005/0242711 A1 11/2005 Bloomfield
2005/0276053 A1 12/2005 Nortrup et al. ..... 362/294
2006/0097245 A1 5/2006 Aanegola et al. ..... 257/26
2006/0097385 A1 5/2006 Negley ..... 257/722
2006/0105482 A1 5/2006 Alferink et al. ..... 438/22
2006/0138435 A1 6/2006 Tarsa et al. ..... 257/89
2006/0152140 A1 7/2006 Brandes ..... 313/503
2006/0152820 A1 7/2006 Lien et al. ..... 359/726
2006/0180774 A1 8/2006 Endo ..... 250/485.1
2006/0227558 A1 10/2006 Osawa et al.
2006/0250792 A1 11/2006 Izardel ..... 362/231
2007/0047232 A1 3/2007 Kim et al.
2007/0090737 A1 * 4/2007 Hu et al. ..... 313/11
2007/0091633 A1 4/2007 Harrity et al.
2007/0139938 A1 6/2007 Petroski
2007/0139949 A1 6/2007 Tanda et al. ..... 362/551
2007/0158668 A1 7/2007 Tarsa et al. ..... 257/98
2007/0182299 A1 8/2007 Ouderkirk ..... 313/110

(56) References Cited

U.S. PATENT DOCUMENTS

2007/0206375 A1 9/2007 Lys
2007/0215890 A1 9/2007 Harbers et al.
2007/0223219 A1 9/2007 Medendorp
2007/0263405 A1 11/2007 Ng et al. ..... 362/555
2007/0267976 A1 11/2007 Bohler et al. ..... 315/112
2007/0274080 A1 11/2007 Negley et al. ..... 362/341
2007/0285924 A1 12/2007 Morris et al. ..... 362/264
2007/0297183 A1 12/2007 Coushaine
2008/0037257 A1 2/2008 Bolta
2008/0055908 A1* 3/2008 Wu et al. ..... 362/294
2008/0062694 A1* 3/2008 Lai et al. ..... 362/294
2008/0080165 A1 4/2008 Kim et al.
2008/0093615 A1 4/2008 Lin et al.
2008/0106893 A1 5/2008 Johnson et al.
2008/0117620 A1 5/2008 Hama et al. ..... 362/84
2008/0128735 A1 6/2008 Yoo et al.
2008/0149166 A1 6/2008 Beeson et al. ..... 136/248
2008/0173884 A1 7/2008 Chitnis et al. ..... 257/98
2008/0179611 A1 7/2008 Chitnis et al. ..... 257/98
2008/0232119 A1 9/2008 Ribarich ..... 362/373
2008/0285279 A1 11/2008 Ng et al. ..... 362/249
2008/0308825 A1 12/2008 Chakraborty et al. ..... 257/98
2009/0001399 A1 1/2009 Diana et al. ..... 257/98
2009/0015137 A1 1/2009 Su et al. ..... 313/503
2009/0040760 A1* 2/2009 Chen et al. ..... 362/249
2009/0046473 A1 2/2009 Tsai et al. ..... 362/373
2009/0058256 A1 3/2009 Mitsuishi et al. ..... 313/487
2009/0059559 A1 3/2009 Pabst
2009/0067180 A1 3/2009 Tahmosybayat ..... 362/339
2009/0086492 A1 4/2009 Meyer
2009/0086508 A1 4/2009 Bierhuizen ..... 362/617
2009/0095960 A1 4/2009 Murayama ..... 257/79
2009/0101930 A1 4/2009 Li
2009/0103293 A1 4/2009 Harbers ..... 362/231
2009/0103296 A1 4/2009 Harbers et al.
2009/0116217 A1 5/2009 Teng et al.
2009/0140633 A1 6/2009 Tanimoto ..... 313/503
2009/0141474 A1 6/2009 Kolodin
2009/0175041 A1 7/2009 Yuen et al.
2009/0184618 A1 7/2009 Hakata et al.
2009/0190353 A1 7/2009 Barker ..... 362/249
2009/0195186 A1 8/2009 Guest et al. ..... 315/294
2009/0201679 A1 8/2009 Konaka ..... 362/235
2009/0208307 A1 8/2009 Guyton ..... 362/234
2009/0217970 A1 9/2009 Zimmerman et al. ..... 136/252
2009/0262516 A1 10/2009 Li ..... 362/84
2009/0273727 A1 11/2009 Kubota et al. ..... 349/62
2009/0273924 A1 11/2009 Chiang ..... 362/241
2009/0283779 A1 11/2009 Negley et al. ..... 257/88
2009/0286337 A1 11/2009 Lee ..... 438/27
2009/0296387 A1 12/2009 Reisenauer et al. ..... 362/235
2009/0310368 A1 12/2009 Incerti ..... 362/326
2009/0316073 A1 12/2009 Chen et al. ..... 349/64
2009/0316383 A1 12/2009 Son
2009/0322197 A1 12/2009 Helbing ..... 445/48
2009/0322208 A1 12/2009 Shaikevitch ..... 313/503
2009/0322800 A1 12/2009 Atkins ..... 345/690
2009/0323333 A1 12/2009 Chang
2010/0014839 A1 1/2010 Benoy et al. ..... 386/117
2010/0020547 A1 1/2010 Olsson ..... 362/311
2010/0025700 A1 2/2010 Jung et al.
2010/0026185 A1 2/2010 Betsuda et al. ..... 315/32
2010/0027258 A1 2/2010 Maxik et al. ..... 362/240
2010/0038660 A1* 2/2010 Shuja ..... 257/98
2010/0046231 A1 2/2010 Medinis ..... 362/294
2010/0060144 A1 3/2010 Justel et al. ..... 313/503
2010/0091487 A1 4/2010 Shin ..... 362/235
2010/0096967 A1 4/2010 Marinus et al. ..... 313/46
2010/0102707 A1 4/2010 Fukuda et al. ..... 313/503
2010/0134047 A1 6/2010 Hasnain
2010/0140655 A1 6/2010 Shi ..... 257/99
2010/0149783 A1 6/2010 Takenaka et al. ..... 362/84
2010/0149814 A1 6/2010 Zhai et al. ..... 257/88
2010/0155763 A1 6/2010 Donofrio
2010/0170075 A1 7/2010 Kanade et al. ..... 29/428
2010/0177522 A1 7/2010 Lee ..... 362/373
2010/0201284 A1 8/2010 Kraus
2010/0207502 A1* 8/2010 Cao et al. ..... 313/46
2010/0219735 A1 9/2010 Sakai et al. ..... 313/46
2010/0232134 A1 9/2010 Tran ..... 362/84
2010/0244729 A1 9/2010 Chen et al. ..... 315/291
2010/0246165 A1 9/2010 Diaz et al. ..... 362/183
2010/0259918 A1 10/2010 Rains, Jr. ..... 362/84
2010/0264799 A1 10/2010 Liu et al. ..... 313/46
2010/0264826 A1* 10/2010 Yatsuda ..... F21K 9/00 315/112
2010/0314985 A1 12/2010 Premysler ..... 313/46
2010/0327745 A1 12/2010 Dassanayake ..... 315/35
2010/0327755 A1 12/2010 Dassanayake ..... 315/35
2010/0328925 A1 12/2010 Hoelen ..... 362/84
2011/0037368 A1 2/2011 Huang ..... 313/46
2011/0044022 A1 2/2011 Ko et al. ..... 362/84
2011/0058379 A1 3/2011 Diamantidis ..... 362/296.01
2011/0068356 A1 3/2011 Chiang ..... 257/98
2011/0074271 A1 3/2011 Takeshi et al. ..... 313/46
2011/0074296 A1* 3/2011 Shen et al. ..... 315/112
2011/0080096 A1 4/2011 Dudik et al. ..... 315/112
2011/0080740 A1 4/2011 Allen ..... 362/294
2011/0089804 A1 4/2011 Mahalingam et al. ..... 313/46
2011/0089830 A1* 4/2011 Pickard et al. ..... 315/32
2011/0095686 A1 4/2011 Falicoff et al. ..... 315/35
2011/0133222 A1 6/2011 Allen et al. ..... 257/88
2011/0149563 A1 6/2011 Hsia ..... 362/221
2011/0149578 A1 6/2011 Niiyama ..... 362/294
2011/0175528 A1 7/2011 Rains et al. ..... 315/51
2011/0176316 A1 7/2011 Phipps et al.
2011/0205733 A1 8/2011 Lenderink et al. ..... 362/231
2011/0215696 A1 9/2011 Tong et al. ..... 313/46
2011/0215699 A1 9/2011 Le et al.
2011/0216523 A1 9/2011 Tong et al. ..... 362/84
2011/0242816 A1 10/2011 Chowdhury et al. ..... 362/294
2011/0267835 A1 11/2011 Boonekamp et al. ..... 362/555
2011/0273072 A1 11/2011 Oki ..... 313/46
2011/0291560 A1 12/2011 Wang et al. ..... 315/32
2011/0298371 A1 12/2011 Brandes et al. ..... 315/32
2012/0040585 A1 2/2012 Huang
2012/0155059 A1 6/2012 Hoelen et al. ..... 362/84
2012/0161626 A1 6/2012 Van de Ven et al. ..... 315/35
2012/0241778 A1 9/2012 Franck ..... 257/88
2012/0320591 A1 12/2012 Liao et al. ..... 362/249
2013/0049018 A1 2/2013 Ramer et al. ..... 257/81
2013/0063945 A1 3/2013 Wu et al. ..... 362/249
2013/0119280 A1 5/2013 Fuchi et al. ..... 250/504 R
2013/0249374 A1 9/2013 Lee et al. ..... 313/12
2013/0293098 A1 11/2013 Li et al. ..... 313/512

FOREIGN PATENT DOCUMENTS

CN 1608326 4/2005
CN 1726410 1/2006
CN 1802533 7/2006
CN 1922286 A 2/2007
CN 101012916 A 8/2007
CN 101128695 2/2008
CN 10126232 A 9/2008
CN 101262032 9/2008
CN 101262032 A 9/2008
CN 1013388887 A 1/2009
CN 101368719 A 2/2009
CN 101440938 A 5/2009
CN 101501388 A 8/2009
CN 101641623 2/2010
CN 102077011 5/2011
DE 4311937 A1 10/1994
DE 10251955 5/2004
DE 10251955 A1 5/2004
DE 102004051382 4/2006
DE 102006061164 6/2008
DE 10 2007 037862 A1 10/2008
DE 202008013667 12/2008
DE 102011004718 8/2012
EP 0876085 11/1998
EP 0876085 A2 11/1998
EP 0890059 A1 1/1999

(56) References Cited

FOREIGN PATENT DOCUMENTS

| | | | |
|---|---|---|---|
| EP | 0936682 | A1 | 8/1999 |
| EP | 1058221 | A2 | 12/2000 |
| EP | 1881259 | | 1/2008 |
| EP | 2146135 | A2 | 1/2010 |
| EP | 2154420 | | 2/2010 |
| EP | 2469154 | | 6/2012 |
| FR | 2941346 | | 7/2010 |
| GB | 1423011 | | 1/1976 |
| GB | 2345954 | A | 7/2000 |
| GB | 2 366 610 | A | 3/2002 |
| GB | 2366610 | | 3/2002 |
| GB | 2366610 | A | 3/2002 |
| JP | H03081903 | | 4/1991 |
| JP | H06283006 | | 10/1994 |
| JP | H09265807 | | 10/1997 |
| JP | H11177149 | | 7/1999 |
| JP | 11-213730 | A | 8/1999 |
| JP | H011260125 | | 9/1999 |
| JP | 2000022222 | | 1/2000 |
| JP | 2000173304 | | 6/2000 |
| JP | 2001118403 | | 4/2001 |
| JP | 2002525814 | | 8/2002 |
| JP | 2003515899 | | 5/2003 |
| JP | 2004146225 | | 5/2004 |
| JP | 2004241318 | | 8/2004 |
| JP | 2005-093097 | A | 4/2005 |
| JP | 2005108700 | | 4/2005 |
| JP | 20051008700 | | 4/2005 |
| JP | 2005244226 | | 9/2005 |
| JP | 2005-286267 | A | 10/2005 |
| JP | 2005277127 | | 10/2005 |
| JP | 2006019676 | | 1/2006 |
| JP | 2006108661 | | 4/2006 |
| JP | 2006148147 | | 6/2006 |
| JP | 2006156187 | | 6/2006 |
| JP | 20066159187 | | 6/2006 |
| JP | WO2006065558 | | 6/2006 |
| JP | 200640850 | A | 9/2006 |
| JP | 2006525648 | | 11/2006 |
| JP | 2006331683 | | 12/2006 |
| JP | 2007049019 | | 2/2007 |
| JP | A2007049019 | | 2/2007 |
| JP | 200759930 | | 3/2007 |
| JP | 2007059911 | | 3/2007 |
| JP | 2007081090 | | 3/2007 |
| JP | 2007184330 | | 7/2007 |
| JP | 3138653 | | 12/2007 |
| JP | 2008505448 | | 2/2008 |
| JP | 2008508742 | | 3/2008 |
| JP | 2008091140 | | 4/2008 |
| JP | 2008108835 | | 5/2008 |
| JP | 2008523639 | | 7/2008 |
| JP | 2008187195 | | 8/2008 |
| JP | 2008262765 | | 10/2008 |
| JP | 200828183 | | 11/2008 |
| JP | 2008288409 | | 11/2008 |
| JP | 2008300117 | | 12/2008 |
| JP | 2008300203 | | 12/2008 |
| JP | 2008300460 | | 12/2008 |
| JP | 2008300570 | | 12/2008 |
| JP | 2009-016058 | A | 1/2009 |
| JP | 2009016058 | | 1/2009 |
| JP | 2009016153 | | 1/2009 |
| JP | 2009021264 | | 1/2009 |
| JP | 2009059896 | | 3/2009 |
| JP | 2009117346 | | 5/2009 |
| JP | WO2009093163 | | 7/2009 |
| JP | u3153766 | | 8/2009 |
| JP | 2009238960 | | 10/2009 |
| JP | WO2009119038 | | 10/2009 |
| JP | 2009266780 | | 11/2009 |
| JP | 2009277586 | | 11/2009 |
| JP | 2009295299 | | 12/2009 |
| JP | WO2009148543 | | 12/2009 |
| JP | 2010016223 | | 1/2010 |
| JP | 2010040494 | | 2/2010 |
| JP | 2010050473 | | 3/2010 |
| JP | 2010129300 | | 6/2010 |
| JP | 2010267826 | | 11/2010 |
| KR | WO2009028861 | | 3/2009 |
| KR | 100944181 | | 2/2010 |
| KR | 1020100037353 | | 4/2010 |
| KR | 100980588 | B1 | 9/2010 |
| KR | 3020110008445 | | 3/2011 |
| TW | 200505054 | | 2/2005 |
| TW | 200527664 | | 8/2005 |
| TW | 200618339 | | 6/2006 |
| TW | 200619744 | | 6/2006 |
| TW | M309750 | | 4/2007 |
| TW | 200739151 | | 10/2007 |
| TW | 200806922 | | 2/2008 |
| TW | 200907239 | | 2/2009 |
| TW | 200928435 | | 7/2009 |
| TW | 200930937 | | 7/2009 |
| TW | 200938768 | | 9/2009 |
| TW | 200943592 | | 10/2009 |
| TW | D134005 | | 3/2010 |
| TW | 100300960 | | 3/2011 |
| TW | D141681 | | 7/2011 |
| WO | WO 00/17569 | A1 | 3/2000 |
| WO | WO0124583 | A1 | 4/2001 |
| WO | WO 01/40702 | A1 | 6/2001 |
| WO | WO0160119 | A2 | 8/2001 |
| WO | WO2004068599 | | 8/2004 |
| WO | WO2004100213 | | 11/2004 |
| WO | WO2004100213 | A2 | 11/2004 |
| WO | WO2005107420 | A2 | 11/2005 |
| WO | WO2006012043 | | 2/2006 |
| WO | WO2006059535 | A2 | 6/2006 |
| WO | WO2006065558 | | 6/2006 |
| WO | WO 2007/130358 | A2 | 11/2007 |
| WO | WO2007146566 | A2 | 12/2007 |
| WO | WO 2008/018002 | A2 | 2/2008 |
| WO | WO2008018002 | | 2/2008 |
| WO | WO 2008/052318 | A1 | 5/2008 |
| WO | WO 2008/117211 | A1 | 10/2008 |
| WO | WO2008134056 | A1 | 11/2008 |
| WO | WO 2008/146229 | A2 | 12/2008 |
| WO | WO2008146229 | | 12/2008 |
| WO | WO 2009/024952 | A2 | 2/2009 |
| WO | WO2009052099 | | 4/2009 |
| WO | WO 2009/091562 | A2 | 7/2009 |
| WO | WO 2009/093163 | A2 | 7/2009 |
| WO | WO2009091562 | | 7/2009 |
| WO | WO2009093163 | | 7/2009 |
| WO | WO2009093163 | A2 | 7/2009 |
| WO | WO 2009/107052 | A1 | 9/2009 |
| WO | WO2009107052 | | 9/2009 |
| WO | WO 2009/119038 | A2 | 10/2009 |
| WO | WO 2009/128004 | A1 | 10/2009 |
| WO | WO2009119038 | | 10/2009 |
| WO | WO2009125314 | A2 | 10/2009 |
| WO | WO2009131627 | | 10/2009 |
| WO | WO2009143047 | A2 | 11/2009 |
| WO | WO 2009/158422 | A1 | 12/2009 |
| WO | WO2009158422 | | 12/2009 |
| WO | WO2009158422 | A1 | 12/2009 |
| WO | WO 2010/012999 | A2 | 2/2010 |
| WO | WO2010012999 | | 2/2010 |
| WO | WO2010013893 | | 2/2010 |
| WO | WO2010013898 | A2 | 2/2010 |
| WO | WO2010052640 | | 5/2010 |
| WO | WO 2010/119618 | A1 | 10/2010 |
| WO | WO 2010/128419 | A1 | 11/2010 |
| WO | WO2011100193 | | 8/2011 |
| WO | WO2011109091 | A1 | 9/2011 |
| WO | WO2011109098 | | 9/2011 |

(56) References Cited

FOREIGN PATENT DOCUMENTS

| | | |
|---|---|---|
| WO | WO2012011279 | 1/2012 |
| WO | WO2012031533 | 3/2012 |

OTHER PUBLICATIONS

Notice to Submit a Response from Korean Patent Application No. 30-2011-0008446, dated Oct. 22, 2012.
Search Report and Written Opinion from PCT Application No. PCT/US2012/072108, dated Feb. 27, 2013.
International Search Report and Written Opinion for PCT/US2011/000400 mailed May 2, 2011.
International Search Report and Written Opinion for PCT Application No. PCT/US2010/003146 mailed Jun. 7, 2011.
U.S. Appl. No. 13/018,245, filed Jan. 31, 2011, Tong.
U.S. Appl. No. 12/901,405, filed Oct. 8, 2010, Tong.
U.S. Appl. No. 61/339,515, filed Mar. 3, 2010, Tong.
U.S. Appl. No. 12/848,825, filed Aug. 2, 2010, Tong.
U.S. Appl. No. 12/975,820, Van De Ven.
U.S. Appl. No. 13/029,063, filed Feb. 16, 2011, Hussell.
International Search Report and Written Opinion for counterpart PCT Application No. PCT/US2011/000397 mailed May 24, 2011.
International Search Report and Written Opinion for PCT/US2011/000398 mailed Aug. 30, 2011.
International Search Report and Written Opinion for PCT/US2011/000406 mailed Sep. 15, 2011.
International Search Report and Written Opinion for PCT/US2011/000403 mailed Aug. 23, 2011.
International Search Report and Written Opinion for PCT/US2011/000404 mailed Aug. 25, 2011.
Decision for Final Rejection for Japanese Patent Application No. 2001-542133 mailed Jun. 28, 2011.
U.S. Appl. No. 12/566,195, Van De Ven, filed Sep. 24, 2009.
U.S. Appl. No. 12/704,730, Van De Ven, filed Feb. 12, 2010.
U.S. Appl. No. 13/017,778, Andrews, et al, filed Jan. 31, 2011.
Office Action of the IPO for Taiwan Patent Application No. TW 100300962 issued Nov. 21, 2011.
Office Action of the IPO for Taiwan Patent Application No. TW 100300961 issued Nov. 16, 2011.
Office Action of the IPO for Taiwan Patent Application No. TW 100300960 issued Nov. 15, 2011.
Office Action of the IPO for Taiwan Patent Application No. TW 100302770 issued Jan. 13, 2012.
International Search Report and Written Opinion for PCT Patent Application No. PCT/US2011/000405 mailed Nov. 2, 2011.
International Search Report and Written Opinion for PCT/US2011/000407 mailed Nov. 16, 2011.
U.S. Appl. No. 61/435,759, filed Jan. 24, 2011.
U.S. Appl. No. 61/339,516, filed Mar. 3, 2010 Tong.
U.S. Appl. No. 61/424,670, filed Dec. 19, 2010, Zongjie Yuan.
Cree. XLAMP® LEDs, Product Info and Data Sheets, 34 Pages.
Nichia Corp Part Spec, *High Brightness LEDs*, (May 1999), 15 Pgs. Ea, (NSPW 300BS, NSPW 312BS, Etc).
U.S. Appl. No. 13/022,490, filed Feb. 7, 2011, Tong.
International Search Report and Written Opinion for PCT Application No. PCT/US2011/000399 mailed Jul. 12, 2011.
Decision to Refuse a European Patent Application for EP 09 152 962.8 dated Jul. 6, 2011.
International Search Report and Written Opinion for PCT Application No. PCT/US2011/000402 mailed Sep. 30, 2011.
International Search Report and Written Opinion for PCT Application No. PCT/US2011/000391 mailed Oct. 6, 2011.
Energy Star® Program Requirements for Integral LED Lamps, amended Mar. 22, 2010.
U.S. Appl. No. 12/757,179, filed Apr. 9, 2010, Yuan, et al.
U.S. Appl. No. 13/358,901, filed Jan. 26, 2012, Progl, et al.
U.S. Appl. No. 11/656,759, filed Jan. 22, 2007, entitled "Wafer Level Phosphor Coating, Method and Devices Fabricated Utilizing Method", to Chitnis et al.
U.S. Appl. No. 11/899,790, filed Sep. 7, 2007, entitled "Wafer Level Phosphor Coating Method and Devices Fabricated Utilizing Method", to Chitnis et al.
U.S. Appl. No. 11/473,089, filed Jun. 21, 2006, entitled "Close Loopelectrophoretic Deposition of Semiconductor Devices", to Tarsa et al.
C. Crane Company, GeoBulb®-II LED Light Bulb, Data Sheet dated Aug. 18, 2010, available at https//www.ccrane.com/lights/led-light-bulbs/geobulb-led-light-bulb.aspx.
Cree LR4, Recessed architectural Downlight data sheet, dated Aug. 18, 2010, available at http:..ledtheway.com/store/item/37ug9/Cree_LED_Lighting/Cree_LR4_4_Recessed_Architectural . . . .
Cree LR6, Recessed Downlight Module data sheet, dated Aug. 18, 2010, available at http:..ledtheway.com/store/item/37ug8/Cree_LED_Lighting/Cree_LR6_6_Recessed_Downlight_Mo . . . .
Patent Abstracts of Japan, Publication No. 2006040850, Date: Sep. 2, 2006.
PCT International Search Report and Written Opinion, Application No. PCT/US2009/063804, dated: Feb. 26, 2010.
Cree, XLAMP® LEDs, Product Info and Data Sheets, 34 Pages.
Notice to Submit a Response from Korean Patent Application No. 30-2011-0008448, dated Apr. 16, 2012.
Notice to Submit a Response from Korean Patent Application No. 30-2011-0008445, dated Apr. 16, 2012.
Notice to Submit a Response from Korean Patent Application No. 30-2011-0008446, dated Apr. 16, 2012.
Office Action for Taiwanese Patent Application No. 100300961, dated May 7, 2012.
Office Action from Taiwanese Patent Application No. 100300960, dated May 7, 2012.
Notice to Submit a Response from Korean Design Patent Application No. 30-2011-0024961, dated Sep. 10, 2012.
International Search Report and Written Opinion from PCT Application No. PCT/US2011/000389, dated May 6, 2013.
International Search Report and Written Opinion from PCT Application No. PCT/US2011/000390, dated May 6, 2013.
International Preliminary Report on Patentability from PCT/US2011/00389, dated May 8, 2013.
International Preliminary Report on Patentability from PCT/US2011/000390, dated May 8, 2013.
Reasons for Rejection from Japanese Patent Appl. No. 2011-198454, dated Mar. 7, 2013.
Office Action from U.S. Appl. No. 13/022,490, dated Oct. 17, 2013.
Office Action from U.S. Appl. No. 11/149,999, dated May 13, 2013.
Response to OA from U.S. Appl. No. 11/149,999, filed Sep. 13, 2013.
Office Action from U.S. Appl. No. 12/985,275, dated Aug. 27, 2013.
Office Action from U.S. Appl. No. 13/358,901, dated Oct. 9, 2013.
Office Action from U.S. Appl. No. 13/028,863, dated Jul. 30, 2013.
Decision of Dismissal of Amendment, Decision of Rejection from Japanese Patent Appl. No. 2011-231319, dated Oct. 15, 2013.
Office Action from Japanese Patent Appl. No. 2012-556063, dated Oct. 11, 2013.
Office Action from Japanese Patent Appl. No. 2012-556066, dated Oct. 25, 2013.
Office Action from Japanese Patent Appl. No. 2012-556065, dated Oct. 25, 2013.
Office Action from U.S. Appl. No. 13/028,913, dated Nov. 4, 2013.
Notice of Reasons for Rejection from Japanese Patent Appl. No. 2012-543086, dated Aug. 27, 2013.
Office Action from U.S. Appl. No. 13/028,946, dated Jul. 16, 2012.
Response to OA from U.S. Appl. No. 13/028,946, filed Oct. 8, 2012.
Office Action from U.S. Appl. No. 13/029,025, dated Jul. 16, 2013.
Office Action from U.S. Appl. No. 12/901,405, dated Jul. 1, 2013.
Office Action from U.S. Appl. No. 13/018,291, dated Oct. 10, 2012.
Response to OA from U.S. Appl. No. 13/018,291, filed Jan. 7, 2013.
Office Action from U.S. Appl. No. 13/022,490, dated Nov. 7, 2012.
Response to OA from U.S. Appl. No. 13/022,490, filed Feb. 1, 2013.
Office Action from U.S. Appl. No. 13/034,501, dated Dec. 3, 2012.
Response to OA from U.S. Appl. No. 13/034,501, filed Apr. 3, 2013.
Office Action from U.S. Appl. No. 13/028,946, dated Dec. 4, 2012.
Response to OA from U.S. Appl. No. 13/028,946, filed Jan. 29, 2013.

(56) References Cited

OTHER PUBLICATIONS

Office Action from U.S. Appl. No. 13/029,005, dated Jan. 24, 2013.
Office Action from U.S. Appl. No. 12/901,405, dated Jan. 9, 2013.
Response to OA from U.S. Appl. No. 12/901,405, filed Apr. 29, 2013.
Office Action from U.S. Appl. No. 12/985,275, dated Feb. 28, 2013.
Response to OA from U.S. Appl. No. 12/985,275, filed May 28, 2013.
Office Action from U.S. Appl. No. 13/018,291, dated Mar. 20, 2013.
Response to OA from U.S. Appl. No. 13/018,291, filed May 20, 2013.
Office Action from U.S. Appl. No. 13/022,490, dated Apr. 2, 2013.
Office Action from U.S. Appl. No. 13/018,291, dated May 31, 2013.
Office Action from U.S. Appl. No. 12/636,958, dated Jul. 19, 2012.
Response to OA from U.S. Appl. No. 12/636,958, filed Nov. 19, 2012.
Office Action from U.S. Appl. No. 13/054,501, dated May 31, 2013.
Office Action from U.S. Appl. No. 13/028,946, filed Apr. 11, 2013.
Office Action from U.S. Appl. No. 13/028,913, dated Apr. 29, 2013.
Office Action from U.S. Appl. No. 13/029,005, dated Jan. 4, 2013.
Response to OA from U.S. Appl. No. 13/029,005, filed Apr. 17, 2013.
Office Action from U.S. Appl. No. 12/848,825, dated Nov. 25, 2012.
Response to OA from U.S. Appl. No. 12/848,825, filed Feb. 5, 2013.
Office Action from U.S. Appl. No. 13/029,005, dated Jun. 11, 2013.
Office Action from Japanese Patent Appl. No. 2012-556064, dated Oct. 29, 2013.
Office Action from U.S. Appl. No. 13/029,063, dated Oct. 23, 2013.
Office Action from U.S. Appl. No. 13/028,946, dated Oct. 31, 2013.
Office Action from U.S. Appl. No. 13/029,068, dated Nov. 15, 2013.
Office Action from U.S. Appl. No. 13/029,025, dated Dec. 6, 2013.
First Office Action from Chinese Patent Appl. No. 201080062156.X, dated Feb. 12, 2014.
Office Action from U.S. Appl. No. 13/028,913, dated Feb. 19, 2014.
Office Action from U.S. Appl. No. 13/028,863, dated Mar. 4, 2014.
Office Action from U.S. Appl. No. 13/358,901, dated Mar. 6, 2014.
Office Action from U.S. Appl. No. 13/018,291, dated Mar. 7, 2014.
Office Action from U.S. Appl. No. 13/029,025, dated Mar. 19, 2014.
Office Action from Japanese Patent Appl. No. 2012-556066, dated Mar. 14, 2014.
Office Action from U.S. Appl. No. 13/029,063, dated Apr. 1, 2014.
Office Action from U.S. Appl. No. 12/985,275, dated Apr. 10, 2014.
Office Action from U.S. Appl. No. 13/029,068, dated Apr. 24, 2014.
Office Action from U.S. Appl. No. 13/034,501, dated May 5, 2014.
Office Action from U.S. Appl. No. 13/022,490, dated May 6, 2014.
Office Action from U.S. Appl. No. 13/028,863, dated May 9, 2014.
Notice of Reasons for Rejection from Japanese Patent Appl. No. 2012-543086, dated Dec. 24, 2013.
Office Action from Japanese Patent Appl. No. 2012-556062, dated Dec. 20, 2013.
International Preliminary Report on Patentability and Written Opinion from PCT/US2012/044705 dated Jan. 7, 2014.
Office Action from Japanese Patent appl. No. 2012-556063, dated Jan. 28, 2014.
Comments on the Written Opinion and Amendment of the Application from European Patent appl. No. 12790244.4, dated Feb. 20, 2014.
International Search Report and Written Opinion from PCT/US2013/057712 dated Feb. 4, 2014.
Office Action from U.S. Appl. No. 11/149,999, dated Jan. 15, 2014.
Office Action from U.S. Appl. No. 13/034,501, dated Jan. 23, 2014.
Office Action from U.S. Appl. No. 13/029,068, dated Jun. 13, 2014.
Office Action from U.S. Appl. No. 13/018,245, dated Jun. 10, 2014.
Decision to Grant from Japanese Patent AppL. No. 2012-556066, dated Jul. 4, 2014.
Decision of Rejection from Japanese Patent Appl. No. 2012-556064, dated Jun. 6, 2014.
First Office Action from Chinese Patent Appl. No. 2011800223856, dated Aug. 1, 2014.
First Office Action from Chinese Patent Appl. No. 2011800226298, dated Aug. 25, 2014.
Official Action from European Patent Appl. No. 11710398.1-1757, dated Oct. 9, 2014.
Office Action from Japanese Patent Appl. No. 2012-556065, dated Aug. 5, 2014.
Office Action from Japanese Patent Appl. No. 2012-556062, dated Aug. 5, 2014.
First Office Action from Chinese Patent Appl. No. 2011800223837, dated Jul. 24, 2014.
Office Action from European Patent Appl. No. 11710906.6-1757, dated Sep. 10, 2014.
First Office Action and Search Report from Chinese Patent Appl. No. 201180022620X, dated Jul. 1, 2014.
Office Action from U.S. Appl. No. 13/358,901, dated Jul. 15, 2014.
Response to OA from U.S. Appl. No. 13/358,901, filed Aug. 21, 2014.
Office Action from U.S. Appl. No. 14/014,272, dated Jul. 29, 2014.
Office Action from U.S. Appl. No. 13/029,025, dated Aug. 6, 2014.
Office Action from U.S. Appl. No. 12/985,275, dated Aug. 7, 2014.
Office Action from U.S. Appl. No. 12/901,405, dated Aug. 7, 2014.
First Office Action from Chinese Patent Application No. 2011800207069, dated May 5, 2014.
First Office Action from Chinese Patent Application No. 201160022606, dated May 4, 2014.
First Office Action from Chinese Patent Appl. No. 201180020709.2, dated May 4, 2014.
Office Action from U.S. Appl. No. 13/028,946, dated May 27, 2014.
Office Action from U.S. Appl. No. 13/028,913, dated May 22, 2014.
Summons to Oral Proceedings from European Patent Appl. No. 09152962/2166580, dated Jan. 29, 2015.
First Office Action from Chinese Patent Appl. No. 2011800225832, dated Jan. 20, 2015.
First Office Action from Chinese Patent Appl. No. 2011800226214, dated Dec. 25, 2014.
Second Office Action and Search Report from Chinese Patent Appl. No. 2011800207092, dated Jan. 22, 2015.
Examination Report from European Patent Appl. No. 11 710 348.1-1757, dated Feb. 18, 2015.
Examination Report from European Patent Appl. No. 11 710 906.6-1757, dated Feb. 18, 2015.
Examination Report from European Patent Appl. No. 12 740 244.4-1757, dated Feb. 9, 2015.
Office Action from U.S. Appl. No. 13/029,063, dated Jan. 13, 2015.
Office Action from U.S. Appl. No. 14/014,272, dated Jan. 14, 2015.
Response to OA from U.S. Appl. No. 14/014,272, filed Mar. 3, 2015.
Office Action from U.S. Appl. No. 12/901,405, dated Feb. 4, 2015.
Office Action from Japanese Patent Appl. No. 2014-122643, dated Apr. 10, 2015.
Second Office Action from Chinese Patent Appl. No. 2011800223856, dated Apr. 16, 2015.
Office Action from Taiwanese Patent Appl. No. 100107048, dated Apr. 24, 2015.
Notice of Decline of Amendments and Final Office Action from Japanese Appl. No. 2012-556065, dated Apr. 10, 2015.
Second Office Action from Chinese Patent Appl. No. 2011800223837, dated Apr. 13, 2015.
Communication from European Patent Appl. No. 13762957.2-1757, dated Apr. 30, 2015.
Office Action and Search Report from Taiwanese Patent Appl. No. 100107051, dated May 12, 2015.
Third Office Action from Chinese Patent Appl. No. 2011800207069, dated Apr. 13, 2015.
Second Office Action from Chinese Patent Appl. No. 2011800226248, dated May 4, 2015.
Office Action from Taiwanese Appl. No. 100107047, dated Jun. 5, 2015.
Second Office Action from Chinese Appl. No. 201180022620X, dated Apr. 20, 2015.
Office Action from Taiwanese Appl. No. 100107040, dated Jun. 5, 2015.
Office Action from Taiwanese Patent Appl. No. 10420724800, dated Jun. 2, 2015.

(56) References Cited

OTHER PUBLICATIONS

Office Action from U.S. Appl. No. 13/029,068, dated Mar. 31, 2015.
Office Action from U.S. Appl. No. 11/149,999, dated Mar. 31, 2015.
Office Action from U.S. Appl. No. 12/985,275, dated Apr. 3, 2015.
Office Action from U.S. Appl. No. 13/029,025, dated Apr. 29, 2015.
Office Action from U.S. Appl. No. 13/018,245, dated May 28, 2015.
Office Action from U.S. Appl. No. 13/028,863, dated Jun. 3, 2015.
Office Action from U.S. Appl. No. 13/758,763, dated Jun. 5, 2015.
Office Action from U.S. Appl. No. 14/185,123, dated Jun. 9, 2015.
Search Report and Office Action from Taiwanese Patent Appl. No. 099143827, dated Jun. 12, 2015.
Office Action from Taiwanese Patent Appl. No. 100107012, dated Jul. 22, 2015.
Decision of Board of Appeal and Minutes of Oral Proceedings from European Appl. No. 09152962, dated Jun. 2, 2015.
Decision to Grant from Chinese Patent Appl. No. 201080062056.X, dated Jul. 6, 2015.
Office Action from Taiwanese Appl. No. 101107038, dated Jul. 21, 2015.
Office Action from Taiwanese Patent Appl. No. 100107042, dated Jun. 2, 2015.
Office Action from Taiwanese Patent Appl. No. 100107047, dated Jun. 2, 2015.
Office Action from Taiwanese Patent Appl. No. 100107040, dated Jun. 2, 2015.
Office Action from Taiwanese Patent Appl. No. 100107044, dated Jun. 1, 2015.
Third Office Action from Chinese Patent Appl. No. 201180022606X, dated Jun. 10, 2015.
Third Office Action from Chinese Patent Appl. No. 2011800207092, dated Jul. 13, 2015.
Notice of Allowance from Japanese Patent Appl. No. 2014-122643, dated Sep. 3, 2015.
Notification of the Fourth Office Action from Chinese Patent Appl. No. 2011800207069, dated Aug. 24, 2015.
Decision of Rejection from Japanese Patent Appl. No. 2012-566065, dated Aug. 18, 2015.
Second Office Action from Chinese Patent Appl. No. 2011800226267, dated Aug. 3, 2015.
Office Action from U.S. Appl. No. 13/029,025, dated Aug. 17, 2015.
Office Action from U.S. Appl. No. 12/985,275, dated Sep. 2, 2015.
Office Action from U.S. Appl. No. 13/029,068, dated Sep. 8, 2015.
Office Action from U.S. Appl. No. 13/029,063, dated Sep. 17, 2015.
Office Action from U.S. Appl. No. 11/149,999, dated Oct. 1, 2015.
Second Office Action from Chinese Appl. No. 201080062056.X, dated Sep. 29, 2014.
First Office Action and Search Report from Chinese Appl. No. 2011800223856, dated Aug. 1, 2014.
Communication from European Appl. No. 12816621.2-1757, dated Sep. 25, 2014.
Pretrial Report from Japanese Patent Appl. No. 2011-231319, dated Apr. 14, 2014.
Examination from European Patent Appl. No 10799139.0, dated Nov. 18, 2015.
Request for Correction from Chinese Patent Appl. No. 201180022606X. dated Nov. 12, 2015.
Third Office Action from Chinese Patent Appl. No. 2011800223856, dated Nov. 2, 2015.
Office Action from U.S. Appl. No. 13/536,707, dated Nov. 16, 2015.
Office Action from U.S. Appl. No. 14/185,123, dated Nov. 17, 2015.
Office Action from U.S. Appl. No. 13/029,068, dated Dec. 3, 2015.
Office Action from U.S. Appl. No. 14/453,482, dated Oct. 1, 2015.
Office Action from U.S. Appl. No. 14/108,815, dated Nov. 5, 2015.
Office Action from U.S. Appl. No. 13/029,068, dated Sep. 26, 2014.
Response to OA from U.S. Appl. No. 13/029,068, filed Nov. 18, 2014.
Office Action from U.S. Appl. No. 13/358,901, dated Oct. 31, 2014.
Office Action from U.S. Appl. No. 13/034,501, dated Nov. 5, 2014.
Office Action from U.S. Appl. No. No. 13/028,863, dated Nov. 10, 2014.
Decision to Grant from Japanese Appl. No. 2012-556062, dated Nov. 27, 2014.
Second Office Action from Chinese Patent Appl. No. 2011800207069, dated Dec. 5, 2014.
First Office Action from Chinese Appl. No. 201180022626.7, dated Nov. 15, 2014.
Second Office Action from Chinese Appl. No. 201180022606X, dated Dec. 23, 2014.
Appeal Decision from Japanese Appl. No. 2011-231319, dated Jan. 13, 2015.
Office Action from U.S. Appl. No. 13/607,300, dated Nov. 19, 2014.
Office Action from U.S. Appl. No. 13/029,025, dated Dec. 11, 2014.
Office Action from U.S. Appl. No. 13/018,245, dated Dec. 11, 2014.
Office Action from U.S. Appl. No. 13/029,068, dated Dec. 23, 2014.
Office Action from U.S. Appl. No. 12/985,275, dated Dec. 29, 2014.
Third Office Action from Chinese Patent Appl. No. 2011800223856—translations only, original already submitted.
Official Notification and Search Report from Taiwanese Patent appl. No. 10421609300, dated Dec. 1, 2015.
Official Notification and Search Report from Taiwanese Patent appl. No. 10421621560, dated Dec. 2, 2015.
Third Office Action from Chinese Patent Appl. No. 2011800226248, dated Nov. 20, 2015.
Official Notification and Search Report from Taiwanese Patent appl. No. 10421651990, dated Dec. 7, 2015.
Notice of Issuance from Chinese Patent Appl. No. 2011800226063X, dated Dec. 10, 2015.
Official Notification and Search Report from Taiwanese Patent Appl. No. 10421595210, dated Nov. 27, 2015.
Office Action from Chinese Patent Appl. No. 201180022583.2, dated Dec. 17, 2015.
Examination from European Patent appl. No. 11 710 906.6-1757, dated Jan. 8, 2016.
Examination from European Patent appl. No. 11 710 348.1-1757, dated Jan. 8, 2016.
Office Action from U.S. Appl. No. 13/029,025; Jan. 6, 2016.
Office Action from U.S. Appl. No. 13/758,763; Feb. 2, 2016.
Office Action from U.S. Appl. No. 13/029,063; Feb. 11, 2016.
Fourth Office Action from Chinese Patent Appl. No. 201180020709.2, Dated Jan. 25, 2016.
Decision of Rejection from Chinese Patent Appl. No. 201182020706.9, dated Mar. 2, 2016.
Re-Examination Report from Japanese Patent Appl. No. 2012-556065, dated Feb. 1, 2016.
Examination Report from European Patent Appl. No. 11 709 509.1-1757, Dated Mar. 4, 2016.
Office Action from U.S. Appl. No. 12/985,275; Feb. 18, 2016.
Office Action from U.S. Appl. No. 14/453,482; Apr. 1, 2016.
Third Office Action for Chinese Application No. 2011800226267; Dated Apr. 6, 2016.
Office Action from U.S. Appl. No. 14/108,815; Dated Apr. 27, 2016.
Fourth Office Action for Chinese Application No. 2011800223856; May 5, 2016.
Fourth Office Action for Chinese Application No 201180022624.8; May 24, 2016.
Fourth Office Action for Chinese Application No. 2011800223837; Jun. 6, 2016.
Office Action from U.S. Appl. No. 13/029,068: Dated Jun. 9, 2016.
Office Action from U.S. Appl. No. 13/536,707: Dated Jun. 23, 2016.
Third Office Action for Chinese Application No. 2011800225832; Dated Jul. 7, 2016.
Notice of Issuance for Chinese Application No. 201180020709.2; Dated Jul. 25, 2016.
Office Action for U.S. Appl. No. 13/758,763; Dated Jul. 26, 2016.
European Office Action for Application No. 11710348.1; Dated Aug. 8, 2016.
Office Action for U.S. Appl. No. 12/985,275; Dated Aug. 30, 2016.
Office Action for U.S. Appl. No. 13/029,063; Dated Sep. 8, 2016.
Notice of Allowance for European Application No. 11710906.6; Dated Sep. 2, 2016.

* cited by examiner

FIG. 1
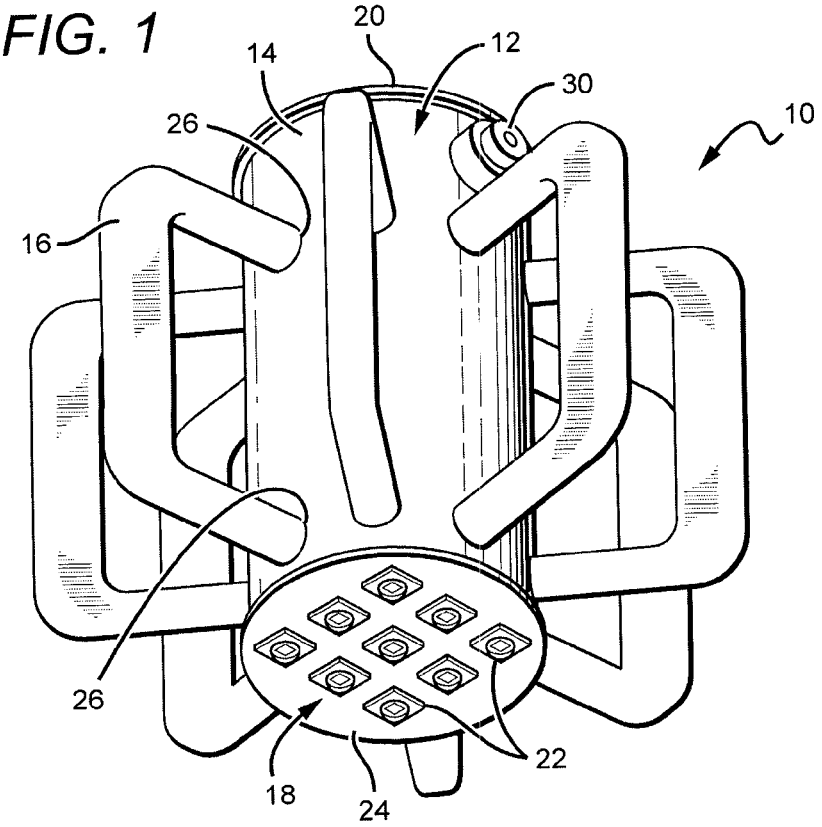
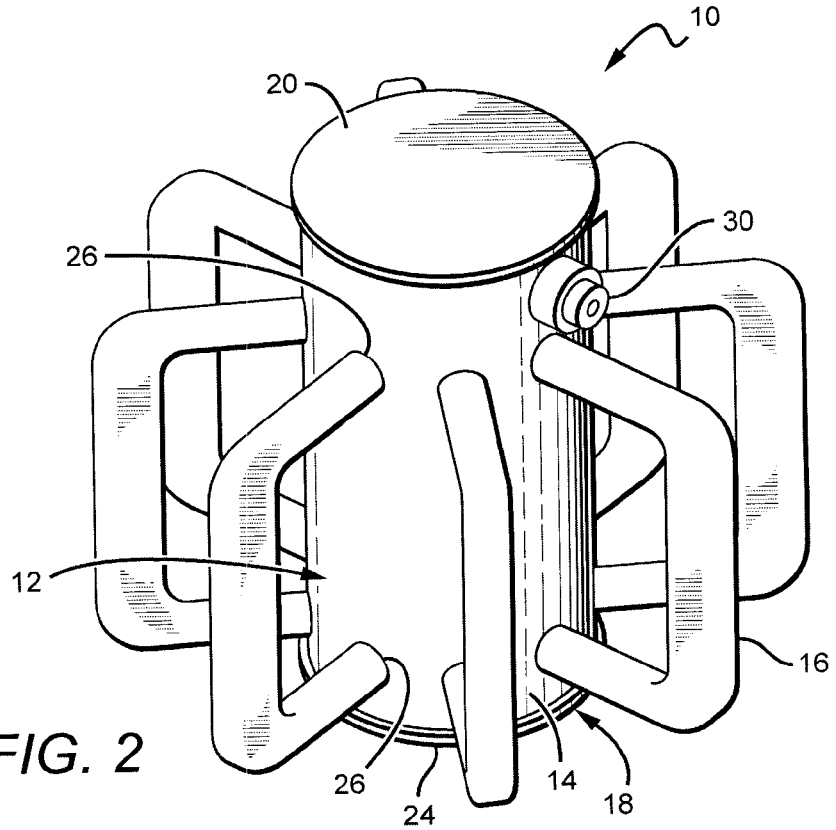
FIG. 2

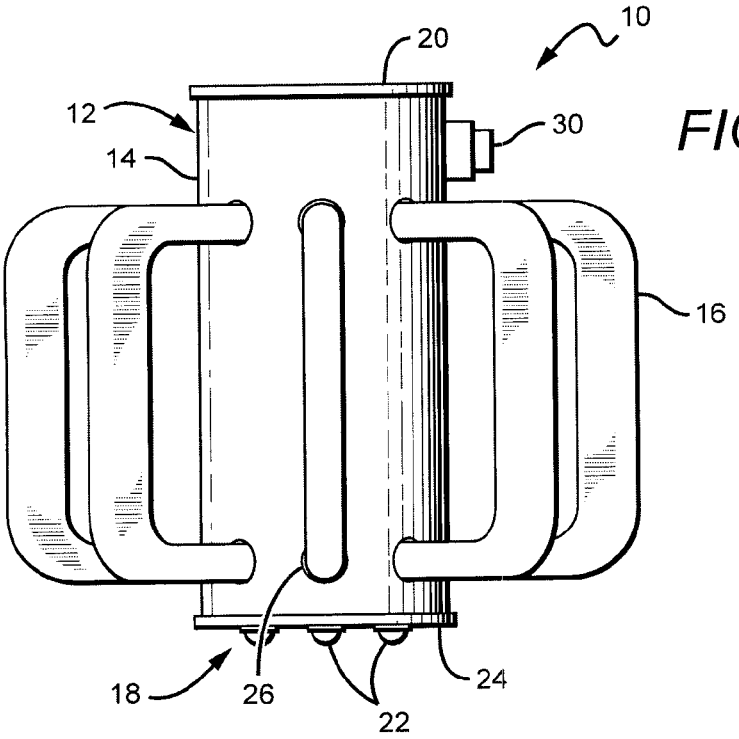
FIG. 3
FIG. 4
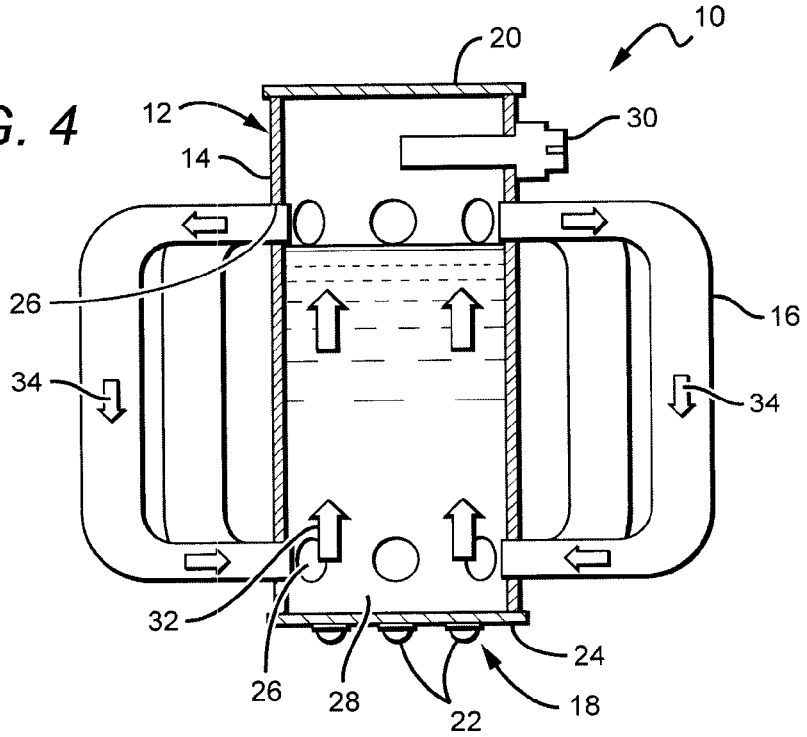

FIG. 5
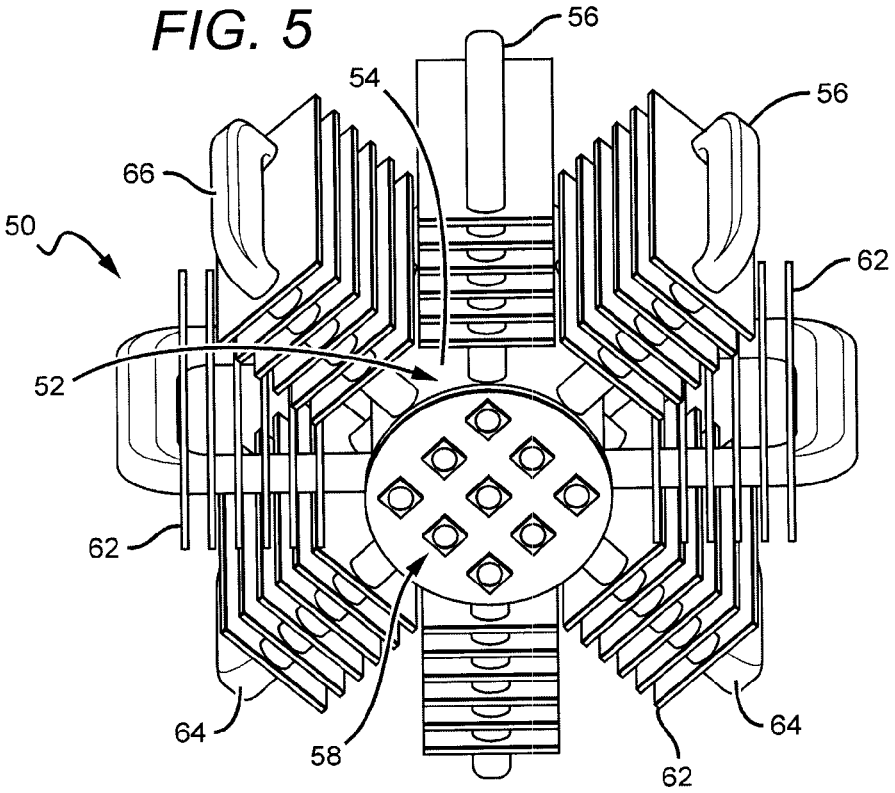
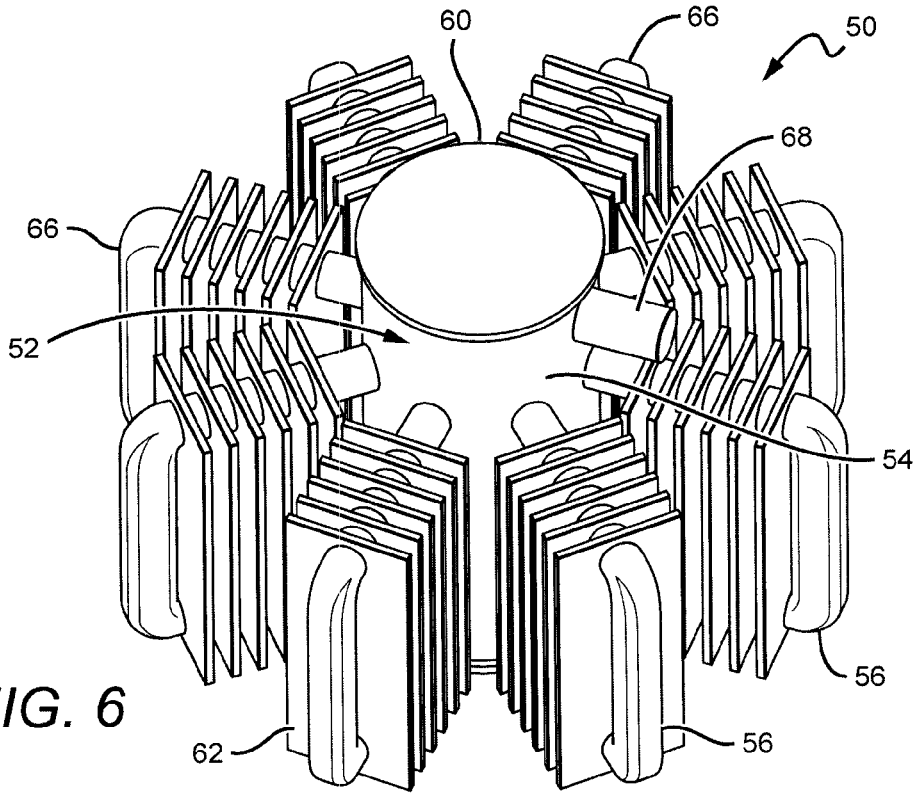
FIG. 6

PASSIVE PHASE CHANGE RADIATORS FOR LED LAMPS AND FIXTURES

BACKGROUND OF THE INVENTION

1. Field of the Invention

The present invention relates generally to lamps or lighting fixtures, and more particularly to lamps and fixtures utilizing light emitting diodes (LEDs) and phase change heat radiators.

2. Description of the Related Art

Light emitting diodes (LED or LEDs) are solid state devices that convert electric energy to light and generally comprise an active region of semiconductor material sandwiched between two oppositely doped layers of semiconductor material. When a bias is applied across the doped layers, holes and electrons are injected into the active region where they recombine to generate light. Light is emitted from the active layer and from all surfaces of the LED.

LEDs can be fabricated to emit light in various colors. However, conventional LEDs cannot generate white light from their active layers. Light from a blue emitting LED has been converted to white light by surrounding the LED with a yellow phosphor, polymer or dye, with a typical phosphor being cerium-doped yttrium aluminum garnet (Ce:YAG). The surrounding phosphor material "downconverts" the energy of some of the LED's blue light which increases the wavelength of the light, changing its color to yellow. Some of the blue light passes through the phosphor without being changed while a portion of the light is downconverted to yellow. The LED emits both blue and yellow light, which combine to provide a white light. In another approach light from a violet or ultraviolet emitting LED has been converted to white light by surrounding the LED with multicolor phosphors or dyes.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

LED based components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips. Techniques for generating white light from a plurality of discrete light sources have been developed that utilize different hues from different discrete light sources, such as those described in U.S. Pat. No. 7,213,940, entitled "Lighting Device and Lighting Method". These techniques mix the light from the discrete sources to provide white light.

In recent years, there have been dramatic improvements in light emitting diode technology such that LEDs of increased brightness and color fidelity have been introduced. Due to these improved LEDs, lighting modules have become available to further increase luminous flux output. Both single and multi-chip modules have become available, with a single-chip module generally comprising a single package with a single LED. Multi-chip lighting modules typically comprise a single package with a plurality of LEDs. These lighting modules, particularly the multi-chip modules, generally allow for high output of light emission, and are particularly useful in LED based lamps and fixtures.

LEDs emitting with high luminous flux can be driven with an elevated electrical drive signal, which in turn can cause the LEDs to operate at elevated temperatures. Operating at elevated temperatures can cause damage to the LEDs and/or their surrounding features, which can reduce their lifespan and reliability. There have been significant efforts directed to features or designs to manage the heat generated by the LED and that can draw heat away from the LEDs, causing the LEDs to operate at lower temperatures. Some of these designs include the use of passive heat radiators such as heat sinks that draw heat away from the LEDs and radiate the heat into the ambient. Heat sinks typically comprise a heat conducting material such as a metal, and some can include heat fins that increase the surface area of the heat sink to increase the amount of heat that transmits into the ambient. These types of heat sinks can be relatively large and bulky, and can result in a lamp that exceeds the desired geometric form factor for the lamp (e.g. standard A19 form factor). In addition, despite their large sizes, many passive heat sinks may not comply with the thermal requirement of the LED lamp or fixture.

Other heat management designs have been developed that utilize active cooling devices, such as fans, to radiate heat from the LEDs. Many of these designs utilize moving parts and can require electrical power to operate. This can result in an overall increase in power consumption for the lamp as well as potential failure of the moving parts.

SUMMARY OF THE INVENTION

The present invention is directed to phase change heat radiators that can be used in many different applications, but are particularly applicable to lamps or light fixtures ("lamp" or "lamps") having solid state light sources such as LEDs. One embodiment of a lamp according to the present invention comprises one or more solid state light emitters and a radiator body with one or more coolant loops. A radiator fluid is included in the radiator body and coolant loops, with the solid state light emitters in thermal contact with the light emitters. Heat from the light emitters causes the radiator fluid to move through the radiator body and coolant loops to radiate heat from the solid state light emitters into the ambient.

Another embodiment of a lamp according to the present invention comprises one or more light emitting diodes (LEDs) and a phase change radiator in thermal contact with the LEDs. The radiator holds a phase change material capable of changing states in response to being heated from the LEDs, with the state change causing movement of the material away from the LEDs. As the material moves away heat from the material is radiated into the ambient. As this occurs the material can return to its cooled state. A path is included for returning the material into thermal contact with the LEDs.

Still another embodiment of a lamp according to the present invention comprise one or more solid state light emitters and a phase change radiator having a radiator fluid. The one or more solid state light emitters are in thermal contact with the radiator fluid, with heat from the light emitters heating a portion of the radiator fluid. The heated fluid then circulates away from the light emitters to radiate heat into the ambient.

These and other further features and advantages of the invention would be apparent to those skilled in the art from the following detailed description, taken together with the accompanying drawings, in which:

BRIEF DESCRIPTION OF THE DRAWINGS

FIG. 1 is a bottom perspective view of one embodiment of a lamp according to the present invention;

FIG. 2 is a top perspective view the lamp shown in FIG. 1;

FIG. 3 is a side view of the lamp shown in FIG. 1;

FIG. 4 is a sectional view of the lamp shown in FIG. 1;

FIG. 5 is a bottom perspective view of another embodiment of an LED lamp according to the present invention;

FIG. 6 is top perspective view of the lamp shown in FIG. 5;

DETAILED DESCRIPTION OF THE INVENTION

Figure 7:
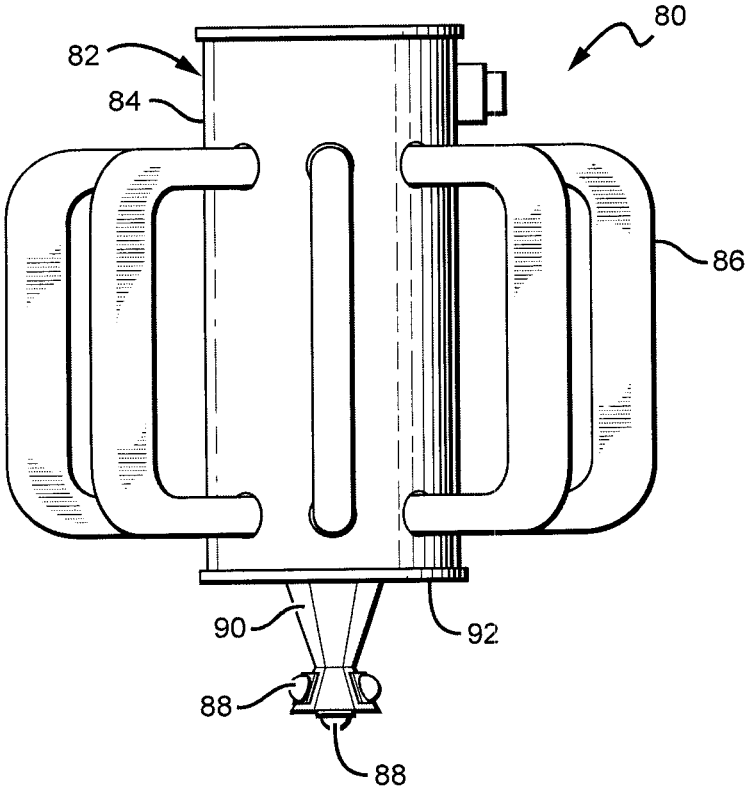
FIG. 7 is a side view of another embodiment of an LED lamp according to the present invention having an LED pedestal.

The present invention provides heat management devices and structures that can be used in lamps and fixtures ("lamps") having solid state light sources, such as one or more LEDs. Some lamp embodiments according to the present invention comprise one or more phase change radiators that utilize the latent heat of fluids to circulate and draw heat away from the LEDs and radiate the heat into the ambient, allowing for the LEDs to operate at a lower temperature. Latent heat is the heat energy required to change a fluid's liquid state to a gas state, and during this phase change state, the temperature does not change. Some phase change radiators according to the present invention can comprise a main radiator body and multiple radiator coolant loops mounted to the body. The present invention relies on the circulation of the "hot" fluid and gas utilizing the pressure differential between the two states. The process converts the LED heat loss energy to the fluid latent heat energy and fluid kinetic energy.

The different embodiments of the phase change radiators according to the present invention can also be constructed using simple and cost effective processes. The main radiator body can be fabricated from a main tubular pipe made of a metal such as copper or other brazable metals or combinations of metals. The radiator coolant loops constructed from smaller pipes made of the same or similar materials as the radiator body and can be pressed and mounted into holes in the radiator body. In still other embodiments, the coolant loops can be cast as one or more radiator banks that can then be attached to the radiator body.

End caps can be mounted over the openings in the end of the radiator body, and one end cap can comprise an LED printed circuit board (PCB). The opposite end cap can comprise a flat plate, with some embodiments having a metallic end plate with a copper-clad surface. In some embodiments, the LED PCB can comprise a metal core PCB such as an aluminum metal core LED PCB with a copper clad surface, and the other end cap can comprise aluminum covered with a copper clad surface. The end caps can be mounted in place using different methods, such as brazing.

The circulation loops can take many different shapes, with the circulation loops shown being U-shaped. The different shapes can be used to maximize surface area, and the loops can travel into any surrounding surface that can assist in radiating heat away from the lamp or fixture. Conventional heat sinks are fabricated by extruding which can have limitations regarding shape of features but the geometric features of the radiator are not constrained by the limitation of extruding. Different embodiments can also have heat fins or panels mounted on the coolant loops to further cool the liquid in the loops. In other embodiment the panels can be at least partially hollow to allow liquid from the coolant loops to enter to further dissipate the heat.

One or more coolant fluids can be included in the phase change radiators according to the present invention, with the coolant fluids being devised and selected for the desired boiling point and desirable working properties. In some embodiments, a "low" boiling point fluid is desired to provide for improved thermal management. Water boils at 100° C. at one atmosphere of pressure. At lower pressure water boils at lower temperatures, such at 80° C., and in vacuum, water can boil at a temperature in the range of 45 to 50° C. With a lower boiling temperature, the liquid within the phase change radiator changes states at a lower temperature, allowing the phase change radiator to conduct heat away from the LEDs at a lower temperature. This can allow improved management of the heat produced by the LEDs, allowing them to operate at lower temperatures. Accordingly, reducing the pressure in the phase change radiators according to the present invention can allow for regulating at lower temperatures.

Other fluids can also have lower boiling temperatures, such as isopropanol which boils at lower temperatures than water at different atmospheric pressures. This material has the additional advantage of not corroding or degrading the metal of the radiator body and coolant loops, as may be the case with water. One disadvantage of these types of materials is that they can exhibit a relatively low flash point. In some embodiments it may be desirable to use a mixture of water and a material with a higher flash point. Mixing the materials can result in a material having a lower boiling temperature, lower flash point, and a material that exhibits a reduction in corrosion or degradation of metal.

In some embodiments, the pressure in the radiator body can be reduced by creating a vacuum in the body and then sealing the body to hold the vacuum. The phase change radiator can only partially be filled with the coolant fluid, leaving a vacuum space that allows a vacuum to be pulled in the radiator. Lowering the pressure in the radiator lowers the boiling point of the coolant fluid, and the vacuum space in the invention allows for adjustable "low" temperature boiling. Creating a vacuum can be accomplished using many different types of valves or other mechanisms that allow for air to be drawn out of the radiator body and then allowing for the valve to be closed to hold the vacuum. Many different valves can be used including Schrader or Presta valves, commonly used with tires, or valves similar to those used with basketballs and volleyballs. In other embodiments, an opening or tube can be have a flange or tube that can be crimped to hold a vacuum with some other embodiments being soldered following crimping to hold the vacuum.

The vacuum space can also allow for expansion of the cooling fluid as it is heated during operation. The heat from the LEDs can cause the fluid to heat and eventually boil, causing the coiling liquid to expand and the fluid level to rise. This allows for the fluid to reach the necessary level or volume within the phase change radiator to allow the fluid to flow efficiently through the coolant loops.

The present invention provides many advantages over conventional all metal cast heat sinks. The embodiments allow for lower operating LED junction temperature, which increases the lifespan of the LED and provides a higher light efficiency operating point (lower LED thermal roll-off efficiency). The different embodiments can provide for scalable thermal handling capacity in the same form factor configuration. The different embodiments can weigh less and are smaller than all metal heat sinks, and can allow for higher power handling capacity.

The present invention is described herein with reference to certain embodiments but it is understood that the invention can be embodied in many different forms and should not be construed as limited to the embodiments set forth herein. In particular, the present invention is described below in regards to light emitting devices, packages, arrays and lamps having substrates coated by a reflective coating typically comprising a carrier material filled with scattering particles of a different refractive index. Reflective coatings are described in U.S. patent application Ser. No. 13/017,778, to Andrews, and U.S. patent application Ser. No. 12/757,179 to Yuan et al., both of which are incorporated herein by reference.

It will be understood that when an element is referred to as being "on", "connected to", "coupled to" or "in contact with" another element, it can be directly on, connected or coupled to, or in contact with the other element or intervening elements may be present. In contrast, when an element is referred to as being "directly on," "directly connected to", "directly coupled to" or "directly in contact with" another element, there are no intervening elements present. Likewise, when a first element is referred to as being "in electrical contact with" or "electrically coupled to" a second element, there is an electrical path that permits current flow between the first element and the second element. The electrical path may include capacitors, coupled inductors, and/or other elements that permit current flow even without direct contact between conductive elements.

Although the terms first, second, etc. may be used herein to describe various elements, components, regions, and/or sections, these elements, components, regions, and/or sections should not be limited by these terms. These terms are only used to distinguish one element, component, region, or section from another element, component, region, or section. Thus, a first element, component, region, or section discussed below could be termed a second element, component, region, or section without departing from the teachings of the present invention.

Embodiments of the invention are described herein with reference to cross-sectional view illustrations that are schematic illustrations of embodiments of the invention. As such, the actual thickness of components can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

FIGS. 1 through 4 show one embodiment of an LED lamp 10 according to the present invention, comprising a phase change radiator 12 comprising a radiator body 14 and coolant loops 16. An LED array 18 is mounted over the first end of the radiator body 14, and an end cap/plate 20 is mounted over the second end, with both having an air and water tight seal with the radiator body. The phase change radiator 12 is arranged to draw heat away from the array of LEDs and dissipate the heat to the ambient. The radiator body 14 can comprise many different materials, with a suitable material being copper.

As mentioned above, the array of LEDs 18 can comprise a plurality of LEDs and in some embodiments the array can comprise LEDs 22 emitting different colors of light that combine to produce the desired lamp emission. In some embodiments the LEDs can emit different colors that combine to produce a white light emission from the lamp 10. In one embodiment, a multicolor source is used to produce white light. Several colored light combinations will yield white light. For example, it is known in the art to combine light from a blue LED with wavelength-converted yellow (blue-shifted-yellow) light to yield white light with correlated color temperature (CCT) in the range between 5000K to 7000K (often designated as "cool white"). Both blue and BSY light can be generated with a blue emitter by surrounding the emitter with phosphors that can be optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to van de Ven et al., herein incorporated by reference. Many different commercially available LEDs can be used such as those commercially available from Cree, Inc. These can include, but not limited to Cree's XLamp® XP-E LEDs or XLamp® XP-G LEDs.

The LEDs 22 can be mounted on a printed circuit board (PCB) 24 that is capable of being mounted on the first end of the radiator body 14. In some embodiments the PCB 24 can be comprise a metal core PCB, such as a copper clad aluminum metal core PCB, that can be mounted to the radiator body 14 using known methods such as brazing. It is understood, that the LED PCB need not be mounted directly to the radiator body 14, but that intervening layers or materials can be used. The end plate 20 can also comprise a metal, such as aluminum, that can be mounted to the second end of the radiator body, also by brazing.

The coolant loops 16 can also comprise metal pipes, but with a smaller diameter than the radiator body 14. The coolant loops 16 can be bent into their desired shape, such as U-shaped in the LED lamp 10, and then can be mounted over holes 26 in the radiator body 14. The loops can comprise different heat conductive materials, with a suitable material being copper that allows for the loops to be brazed in place over the radiator body holes, with an air and watertight seal. The radiator body holes 26 provide a passageway for gas or liquids within the phase change radiator 12 to move between the radiator body 14 and the conductive loops 16. This movement allows for heated gas or liquids to cool as it passes through the conductive loops.

Referring now to FIG. 4, the phase change radiator can be filled with a radiator fluid 28 as discussed above having the desired boiling temperature, flash point, and corrosive characteristics. In some embodiments that fluid can comprise water, while in other embodiments it can comprise other fluids such as isopropyl alcohol or ammonia that may or may not be mixed with water. Isopropyl alcohol has a lower boiling point than water, but can have a danger of a low flash point. All of these materials typically having a lower boiling point as lower pressures, as described above.

The phase change radiator 12 can be partially filled with its radiator fluid 28, leaving space at the of the radiator body 14. This allows room for the radiator fluid to expand during operation, and provides a space for pulling a vacuum within the radiator body 14 to lower pressure within the radiator body 14 and to allow the radiator fluid to boil at a lower temperature. This allows for the phase change action within the phase change radiator to begin at a lower temperature, thereby keeping the LEDs cooler. A vacuum valve 30 can be included near the top of the radiator body, with the valve passing into the open space above the radiator fluid 28. A vacuum can be turned in the radiator body by evacuating air from within the body 14. Once the vacuum is created, the valve can be closed to hold the vacuum. In one embodiment the valve 30 can comprise a rubber vacuum valve that can be vulcanized once a vacuum is achieved to hold the vacuum. Many different valves can be used, including those mentioned above, and in other embodiments a vacuum can be created during manufacturing without the use of a valve.

The phase change radiator 12 can also comprise features for connecting to a source of electricity such as to different electrical receptacles. In some embodiments the phase change radiator 12 can comprise a feature of the type to fit in conventional electrical receptacles. For example, it can include a feature for mounting to a standard Edison socket, which can comprise a screw-threaded portion which can be screwed into an Edison socket. In other embodiments, it can include a standard plug and the electrical receptacle can be a standard outlet, or can comprise a GU24 base unit, or it can be a clip and the electrical receptacle can be a receptacle which receives and retains the clip (e.g., as used in many fluorescent lights). These are only a few of the options for heat sink structures and receptacles, and other arrangements can also be used that safely deliver electricity from the receptacle to the lamp 10.

The lamps according to the present invention can comprise a power supply or power conversion unit that can comprise a driver to allow the bulb to run from an AC line voltage/current and to provide light source dimming capabilities. In some embodiments, the power supply can be housed in or adjacent to a phase change radiator 12 and can comprise an offline constant-current LED driver using a non-isolated quasi-resonant flyback topology. The LED driver can fit within the lamp and in some embodiments can comprise a 25 cubic centimeter volume or less, while in other embodiments it can comprise approximately 22 cubic centimeter volume or less and still in other embodiments 20 cubic centimeters or less. In some embodiments the power supply can be non-dimmable but is low cost. It is understood that the power supply used can have different topology or geometry and can be dimmable as well. Embodiments having a dimmer can exhibit many different dimming characteristics such as phase cut dimmable down to 5% (both leading and trailing edge). In some dimming circuits according to the present invention, the dimming can be realized by decreasing the output current to the LEDs.

The power supply unit can comprise many different components arranged on printed circuit boards in many different ways. The power supply can operate from many different power sources and can exhibit may different operating characteristics. In some embodiments the power supply can be arranged to operate from a 120 volts alternating current (VAC)±10% signal while providing a light source drive signal of greater than 200 milliamps (mA) and/or greater than 10 volts (V). In other embodiments the drive signal can be greater than 300 mA and/or greater than 15V. In some embodiments the drive signal can be approximately 400 mA and/or approximately 22V.

The power supply can also comprise components that allow it to operate with a relatively high level of efficiency. One measure of efficiency can be the percentage of input energy to the power supply that is actually output as light from the lamp light source. Much of the energy can be lost through the operation of the power supply. In some lamp embodiments, the power supply can operate such that more than 10% of the input energy to the power supply is radiated or output as light from the LEDs. In other embodiments more than 15% of the input energy is output as LED light. In still other embodiments, approximately 17.5% of input energy is output as LED light, and in others approximately 18% or greater input energy is output as LED light.

During operation of the lamp 10, an electrical signal is applied to the LED array 18, causing the LEDs 22 to emit light. As this occurs, the LEDs 22 begin to heat and the heat transfers through the metal core PCB 24, to the radiator fluid 28. As the fluid is heated it expands within the radiator body 14, and eventually reaches a boiling temperature, changing some of the fluid to gas. This causes the heated fluids and gas to rise and shown by first arrows 32 in FIG. 4. The heated fluids and gas enter the cooling loops 16 where it begins to cool be radiating heat through the loops 16 to the ambient. As it cools, any gas returns to a liquid state, and continues to cool with remaining fluids. This in turn causes the cooling liquids to travel to the base of the radiator body as shown by second arrows 34. This continuing loop works to efficiently draw heat away from the LEDs, allowing them to operate at a lower temperature.

One lamp embodiment was described with reference to FIGS. 1 through 4, but it is understood that different lamps according to the present invention can be arranged in different ways and can comprise additional features. FIGS. 5 and 6 show another embodiment of LED lamp 50 according to the present invention, comprising a phase change radiator 52 having a radiator body 54 and coolant loops 56. An LED array 58 is mounted to the first end of the radiator body 54 and an end plate 60 is mounted to the second end of the radiator body 54 as described above.

In this embodiment, radiator panels 62 can be mounted on the coolant loops 56 to increase the surface area for dissipating heat in the ambient. The radiator panels 62 can be made of many different thermally conductive materials, such as copper or aluminum and are mounted to and in thermal contact with the coolant loops 56 so that heat from the liquid in the coolant loops conducts into the radiator panels 62. The heat can then spread throughout the radiator panels 62 and into the ambient. This arrangement can increase the thermal handling capacity of the lamp 50 compared to lamps without radiator panels.

The radiator panels 62 can be arranged in many different ways and in the embodiment shown are in alignment with the radiator body 54. It is understood, that in other embodiments the radiator panels can be arranged in different ways and at different angles. For example, some or all of the radiator panels 62 can be orthogonal to the radiator body 54 or at various angles to the radiator body. The lamp 50 is shown with six radiator panels 62 on each coolant loop 56, but it is understood that more or fewer radiator panels can be included on each loop 56, and different ones of the loops can have different numbers of panels 62.

In lamp 50, the radiator panels can be solid and at least partially comprises a thermally conductive material. In other embodiments, the radiator panels 62 can be at least partially hollow. In still other embodiments, the panels 62 can be hollow and arranged so that liquid within the coolant loops 56 also runs through the radiator panels. In these embodiments, each of the coolant loops 56 can have openings on its first lateral section 64 and openings on its second lateral section. Each of the radiator panels can be arranged over an opening in the first lateral portion 64 and second lateral portion 66, so that liquid from the first lateral portion 64 enters the radiator panel's hollow portion. The liquid is then cooled through each radiator panel 62 and with the liquid traveling to the base of the radiator body 54 much in the same way that the cooling liquid in the radiator loops returns to the base of the radiator body 54. The liquid can then recirculate through the radiator body 54 to continue the cooling of the LED array.

Like the embodiments above, the LED lamp 50 can comprise a valve or other mechanism for allowing for the formation of a vacuum in the radiator body 54. In this embodiment, the mechanism comprises a valve (not shown), such as a rubber valve described above, located within a flange 68 (shown in FIG. 6) near the end plate 60. The valve allows for a vacuum to be pulled in the radiator body, and the flange can then be permanently sealed to hold the vacuum in the body 54. As described above, this vacuum allows for the liquid within the radiator body to boil at lower temperatures.

It is understood that different lamps according to the present invention can be arranged in many different ways beyond the embodiments shown above. Many different types of light sources can be used beyond the planar LED array shown above. In some embodiments the light source can comprise one or more LEDs mounted in a three-dimensional manner to achieve the desired emission characteristics. FIG. 7 shows another embodiment of an LED lamp 80 according to the present invention that is similar to the LED lamps described above, and comprises phase change radiator 82 having a radiator body 84 and coolant loops 86. In this embodiment, the lamp's light source can comprise one or more LEDs 88 mounted to a pedestal 90 that at least partially comprises a heat conductive material. The pedestal 90 can be mounted to a front plate 92 that also at least partially comprises a heat conductive material. During operation heat from the LEDs 88 conducts into the pedestal 90, then into the front plate 92, where it can be conducted to the ambient as described above. The LEDs 88 can be arranged on the pedestal 90 to provide the desired lamp emission and thermal characteristics. Various lamp and fixture pedestal arrangements are described in U.S. patent application Ser. No. 12/848,825 to Tong et al., which is incorporated herein by reference.

Figure 8:
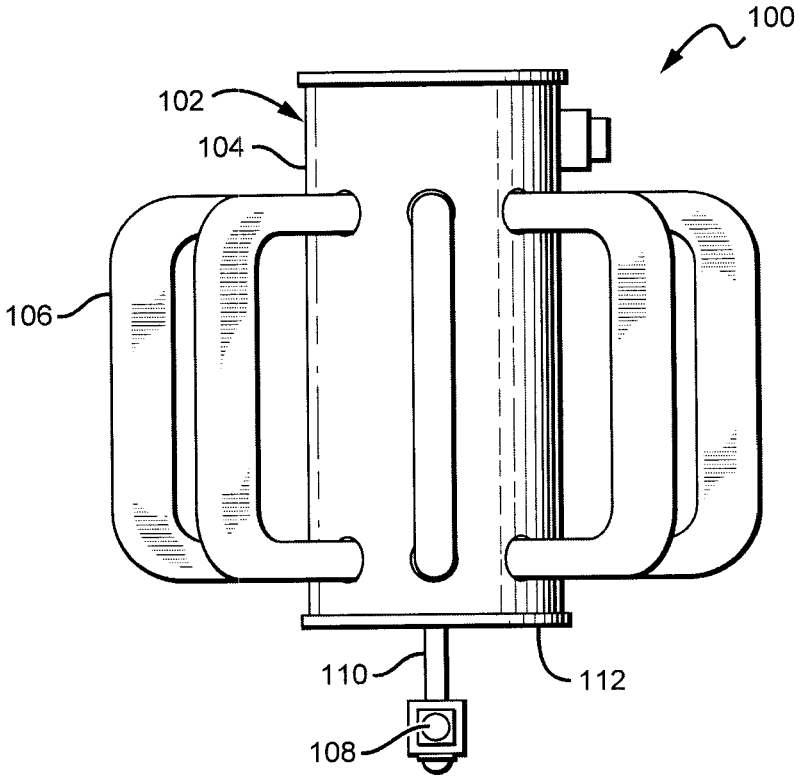
FIG. 8 is a side view of another embodiment of an LED lamp according to the present invention having an LED heat pipe.

FIG. 8 shows still another embodiment of a lamp 100 according to the present invention comprising a phase change radiator 102, radiator body 104, and coolant loops 106, similar to those described above. In this embodiment, one or more LEDs 108 are included that are mounted to one end of a heat pipe 110, with the other end of the heat pipe 110 mounted to the lamp's front plate 112. During operation heat from the LEDs 108 conducts into the heat pipe 110, then into the front plate 112, where the liquid with the phase change radiator 102 conducts the heat to the ambient as described above. Heat pipes are generally known in the art, and the LEDs 108 can be arranged on the pedestal 110 in many different ways to provide the desired lamp emission and thermal characteristics. Various lamp and fixture heat pipe arrangements are described in U.S. patent application Ser. No. 13/358,901, to Progl, which is incorporated herein by reference.

Figure 9:
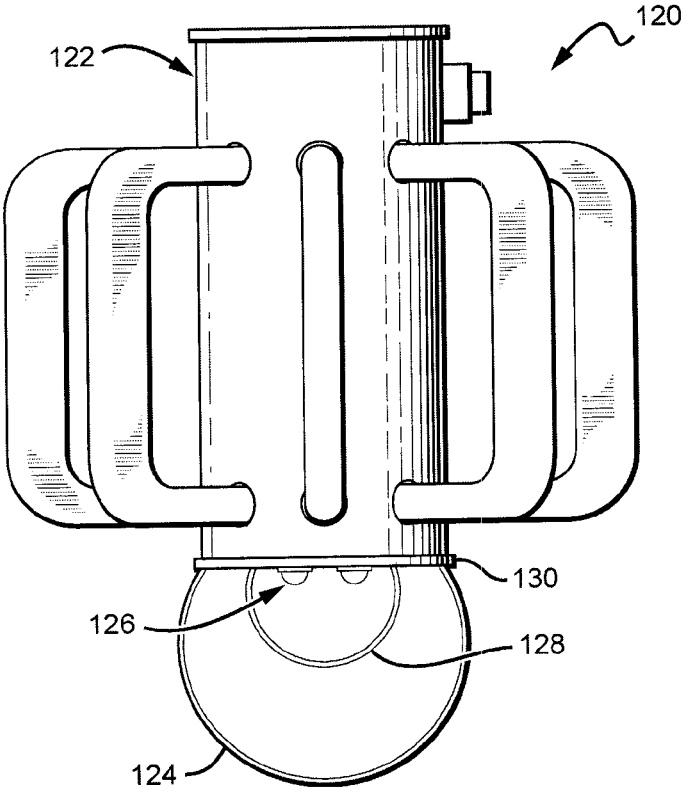
FIG. 9 is a side view of another embodiment of an LED lamp according to the present invention having a diffuser dome.

The LEDs lamps can also be arranged with many additional elements to produce the desired color emission, and emission pattern. FIG. 9 shows another embodiment of lamp 120 according to the present having a phase change radiator 122 as described above. In this embodiment, a diffuser dome 124 can be included over the LED array 126 to help disperse light from the LED array into the desired emission pattern. Other lamp embodiments can also comprise a remote phosphor dome phosphor dome 128 to further change the emission color from the LED array into the desired color and temperature. The diffuser dome 124, LED array 126, and phosphor dome 128 can all be mounted to the front plate 130, so that the phase change radiator can transmit heat to the ambient. Various diffuser dome and remote phosphor arrangements are described in U.S. patent application Ser. No. 13/028,946 and at least some of the patent applications referenced therein, all of which are incorporated by reference.

Figure 10:
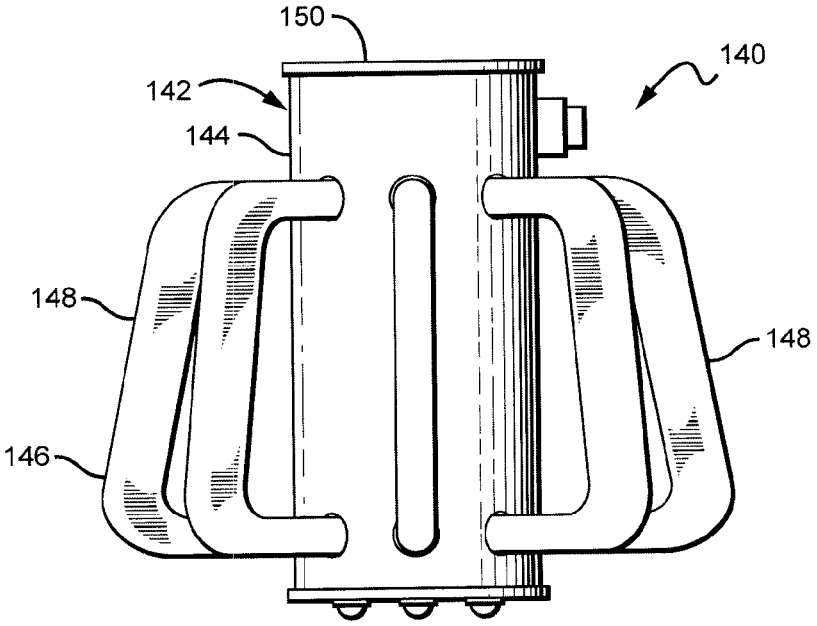
FIG. 10 is a side view of still another embodiment of an LED lamp according to the present invention having angled coolant loops.

As mentioned above, the different elements of the lamps according to the present invention can be arranged in many different ways beyond the embodiments described above. The elements can have many different shapes and sizes to provide the desired lamp emission thermal management characteristics. FIG. 10 shows still another embodiment of a lamp 140 according to the present invention comprising a phase change radiator 142, having a radiator body 144 and coolant loops 146. In this embodiment, the longitudinal sections 148 of the coolant loops 146 can be angled so that the longitudinal sections move closer to the radiator body 144 moving toward the end plate 150. This angling of the longitudinal sections may reduce the amount of light that is blocked by the coolant loops 146, particularly light that is back emitted toward the phase change radiator 142. This coolant loop arrangement may allow for the lamp 140 to meet the requirements of the *ENERGY STAR® Program Requirements for Integral LED Lamps*, amended Mar. 22, 2010, incorporated herein by reference. In some embodiments, not all of the coolant loops are angled, and in other embodiments some of the coolant loops can have different angles.

While several illustrative embodiments of the invention have been shown and described, numerous variations and alternate embodiments will occur to those skilled in the art. For example, many different radiator fluids in different combinations can be used beyond those described above. In some embodiments, a magnetized fluid can be used, and with these phase change radiators a magnet can be used to create a current in the phase change radiator to begin the cooling process. These embodiments can rely on one or both of the actions from the magnets and phase change to create the current to start the cooling process. In still other embodiments, the phase change radiator can take many different shapes and sizes beyond those described above, and the phase change radiators can be used in many different types of lamps and fixtures beyond those described above. Such variations and alternate embodiments are contemplated, and can be made without departing from the spirit and scope of the invention as defined in the appended claims.

We claim:

1. A lamp, comprising:

one or more solid state light emitters;

a phase change radiator comprising a radiator body and a plurality of coolant loops, wherein said coolant loops extend out of said radiator body at a plurality of respective first points and return back to said radiator body at a plurality of respective second different points; and a radiator fluid in said radiator body and coolant loops, said solid state light emitters in thermal contact with said radiator fluid, the heat from said light emitters causing the radiator fluid to circulate through said radiator body and coolant loops to radiate heat from said solid state light emitters into the ambient.

2. The lamp of claim 1, wherein said light emitters comprise light emitting diodes (LEDs).

3. The lamp of claim 1, wherein said light emitters emit a white light from said lamp.

4. The lamp of claim 1, wherein said heated radiator fluid moves away from said LEDs and is cooled as heat from said fluid radiates into the ambient.

5. The lamp of claim 4, wherein said liquid is circulated through said coolant loops back to thermal contact with said light emitters.

6. The lamp of claim 1, further comprising a valve that can be used to form a vacuum in said phase change radiator.

7. The lamp of claim 6, wherein said valve can be closed to allow said phase change radiator to hold its vacuum.

8. The lamp of claim 1, further comprising radiator panels on said coolant loops.

9. The lamp of claim 8, wherein radiator fluid also runs through said panels.

10. The lamp of claim 8, wherein said panels are at least partially hollow.

11. The lamp of claim 1, wherein said light emitters comprise an LED array.

12. The lamp of claim 1, further comprising a thermally conductive pedestal, said light emitters mounted to said pedestal.

13. The lamp of claim 1, further comprising a heat pipe, said light emitters mounted to said heat pipe.

14. The lamp of claim 1, further comprising a diffuser dome over said light emitters.

15. The lamp of claim 1, further comprising a remote phosphor over said LEDs.

16. The lamp of claim 1, wherein said coolant loops comprise a longitudinal section that is angled in relation to said radiator body.

17. A lamp, comprising:

one or more light emitting diodes (LEDs);

a phase change radiator in thermal contact with said LEDs and holding a phase change material capable of changing states in response to being heated from said LEDs, said state change causing movement of said material away from said LEDs with said heat radiated into the ambient as said material moves, said material returning to its cooled state as heat radiated in ambient, wherein said phase change radiator comprises a radiator body and two or more coolant loops, wherein said coolant loops extend out of said radiator body at two or more respective first points and return back to said radiator body at two or more respective second different points, said phase change material circulated through said radiator body and coolant loops; and a continuous path for returning said material within thermal contact of said LEDs.

18. The lamp of claim 17, wherein said phase change material comprises a radiator fluid.

19. The lamp of claim 17, wherein said LEDs emit a white light from said lamp.

20. The lamp of claim 17, further comprising a valve that can be used to form a vacuum in said phase change radiator.

21. The lamp of claim 20, wherein said valve can be closed to allow said phase change radiator to hold its vacuum.

22. The lamp of claim 17, further comprising radiator panels on said coolant loops.

23. The lamp of claim 22, wherein phase change material also runs through said panels.

24. The lamp of claim 17, further comprising a thermally conductive pedestal, said light emitters mounted to said pedestal.

25. The lamp of claim 17, further comprising a heat pipe, said light emitters mounted to said heat pipe.

26. The lamp of claim 17, further comprising a diffuser dome over said light emitters.

27. The lamp of claim 17, further comprising a remote phosphor over said LEDs.

28. The lamp of claim 17, wherein said coolant loops comprise a longitudinal section that is angled in relation to said radiator body.

29. A lamp, comprising:

one or more solid state light emitters; and a phase change radiator having a radiator fluid, said one or more solid state light emitters in thermal contact with said radiator fluid, the heat from said light emitters heating a portion of said radiator fluid and causing said fluid to circulate away from said light emitters, along multiple paths, to radiate heat into the ambient.

* * * * *